US006872157B2

(12) United States Patent
Falone et al.

(10) Patent No.: US 6,872,157 B2
(45) **Date of Patent: *Mar. 29, 2005**

(54) STING MINIMIZING GRIP FOR A HAND HELD SWINGING ATHLETIC CONTACT MAKING ARTICLE

(75) Inventors: Thomas Falone, Mickelton, NJ (US); Carmen Dimario, West Chester, PA (US); Robert A. Vito, Berwyn, PA (US)

(73) Assignee: Sting Free Company, Berwyn, PA (US)

( * ) Notice: Subject to any disclaimer, the term of this patent is extended or adjusted under 35 U.S.C. 154(b) by 37 days.

This patent is subject to a terminal disclaimer.

(21) Appl. No.: 10/067,594

(22) Filed: Feb. 5, 2002

(65) Prior Publication Data

US 2003/0148836 A1 Aug. 7, 2003

(51) Int. Cl.[7] ..... A63B 59/06

(52) U.S. Cl. ..... 473/568; 473/300; 473/549; 473/520; 81/489

(58) Field of Search ..... 473/568, 300, 473/549–551, 303; 81/489

(56) References Cited

U.S. PATENT DOCUMENTS

| | | | |
|---|---|---|---|
| 1,125,029 | A | 1/1915 | Lard |
| 1,195,994 | A | 8/1916 | Lard |
| 1,498,838 | A | 6/1924 | Harrison, Jr. |

(Continued)

FOREIGN PATENT DOCUMENTS

| | | |
|---|---|---|
| DE | 2805314 | 8/1979 |
| GB | 458367 | 6/1935 |

*Primary Examiner*—Mark S. Graham
(74) *Attorney, Agent, or Firm*—Volpe and Koenig, P.C.

(57) ABSTRACT

A grip for minimizing sting in a hand held swinging athletic contacting making article such as a bat, racquet, club or stick is secured to the handle of the article. The grip is a multilayer laminate having an inner layer made from an elastomeric material having high energy absorption and vibration damping characteristics. The laminate also includes an exposed outer layer made from an elastomeric material having a high coefficient of friction and being pliable. In addition, the laminate includes force dissipating material having the characteristics of absorbing and redirecting vibrational energy.

15 Claims, 3 Drawing Sheets

U.S. PATENT DOCUMENTS 1,551,203 A 8/1925 Mills
1,620,118 A 3/1927 Mattern
1,701,856 A 2/1929 Kraeuter
2,023,131 A 12/1935 Gibson
2,099,521 A 11/1937 Herkimer et al.
2,871,899 A 2/1959 Coyle et al.
3,353,981 A 11/1967 Jacob
3,606,326 A 9/1971 Sparks et al.
3,716,433 A 2/1973 Plummer
3,779,551 A * 12/1973 Wilson ..... 473/568
4,015,851 A 4/1977 Pennell
4,044,625 A 8/1977 D'Haem et al.
4,134,198 A 1/1979 Briggs
4,143,109 A 3/1979 Stockum
4,147,443 A 4/1979 Skobel
4,197,611 A 4/1980 Bell et al.
4,217,705 A 8/1980 Donzis
4,261,567 A 4/1981 Uffindell
4,268,574 A 5/1981 Peccenini et al.
4,338,270 A 7/1982 Uffindell
4,347,280 A 8/1982 Lau et al.
4,417,042 A 11/1983 Dziark
4,483,972 A 11/1984 Mitchell
4,552,713 A 11/1985 Cavicchioli
4,591,160 A 5/1986 Piragino
4,597,578 A 7/1986 Lancaster
4,613,537 A 9/1986 Krupper
4,660,832 A 4/1987 Shomo
4,736,949 A 4/1988 Muroi
4,819,939 A 4/1989 Kobayashi
4,864,738 A 9/1989 Horovitz
4,912,836 A 4/1990 Avetoom
4,919,420 A 4/1990 Sato
4,948,131 A 8/1990 Nakanishi
4,953,862 A 9/1990 Uke et al.
4,983,242 A 1/1991 Reed
4,989,643 A 2/1991 Walton et al.
5,005,254 A 4/1991 Uffindell
5,042,804 A 8/1991 Uke et al.
5,083,780 A 1/1992 Walton et al.
5,088,734 A 2/1992 Glava
5,110,653 A 5/1992 Landi
5,122,405 A 6/1992 Landi
5,137,769 A 8/1992 Landi
5,193,246 A 3/1993 Huang
5,199,706 A 4/1993 Chen
5,203,561 A 4/1993 Lanctot
5,240,247 A 8/1993 Didier
5,254,391 A 10/1993 Davis
5,258,088 A 11/1993 Wu
5,261,665 A 11/1993 Downey
5,267,487 A 12/1993 Falco et al.
5,269,516 A 12/1993 Janes
5,282,618 A 2/1994 Hong
5,290,036 A 3/1994 Fenton et al.
5,294,119 A 3/1994 Vincent et al.
5,322,280 A 6/1994 Wu
5,322,285 A 6/1994 Turner
5,322,290 A * 6/1994 Minami ..... 473/201
5,333,861 A 8/1994 Mills
5,338,600 A 8/1994 Fitchmun et al.
5,348,303 A 9/1994 Swissheim
5,355,552 A 10/1994 Huang
5,362,046 A 11/1994 Sims
5,377,979 A 1/1995 Long
5,395,108 A 3/1995 Souders et al.
5,435,549 A 7/1995 Chen
5,463,824 A 11/1995 Barna
5,511,777 A 4/1996 McNeely
5,516,101 A 5/1996 Peng
5,524,885 A 6/1996 Heo
5,528,842 A 6/1996 Ricci et al.
5,547,189 A 8/1996 Billings
5,575,473 A 11/1996 Turner
5,593,158 A 1/1997 Filice et al.
5,621,914 A 4/1997 Ramone et al.
5,624,114 A 4/1997 Kelsey
D379,208 S 5/1997 Kulisek, Jr.
5,636,377 A 6/1997 Wiener
5,653,643 A 8/1997 Falone et al.
5,655,975 A 8/1997 Nashif
5,657,985 A 8/1997 Dahlstrom et al.
5,673,437 A 10/1997 Chase et al.
5,686,158 A 11/1997 Gibbon
5,695,408 A 12/1997 DeLaCruz et al.
5,730,662 A 3/1998 Rens
5,749,798 A 5/1998 Kuebler et al.
5,759,113 A 6/1998 Lai et al.
5,772,524 A 6/1998 Huang
5,840,397 A 11/1998 Landi et al.
5,842,933 A 12/1998 Lewis
5,858,521 A 1/1999 Okuda et al.
5,916,664 A 6/1999 Rudy
5,926,847 A 7/1999 Eibert
5,944,617 A 8/1999 Falone et al.
5,946,734 A 9/1999 Vogan
5,963,989 A 10/1999 Robertson
5,979,081 A 11/1999 Vaz
6,000,062 A 12/1999 Trakh
6,007,439 A 12/1999 MacKay, Jr.
6,216,276 B1 4/2001 Eibert
6,219,940 B1 4/2001 Kita
55,994 A1 12/2001 Kwitek
6,368,989 B1 4/2002 Pascual et al.
6,416,432 B1 7/2002 Rosen et al.
6,558,270 B2 5/2003 Kwitek
6,652,398 B2 * 11/2003 Falone et al. ..... 473/568
6,752,731 B1 * 6/2004 Kramer ..... 473/568
2001/0008053 A1 * 7/2001 Belli ..... 473/549

* cited by examiner

STING MINIMIZING GRIP FOR A HAND HELD SWINGING ATHLETIC CONTACT MAKING ARTICLE

BACKGROUND OF THE INVENTION

Various types of hand held swinging athletic contacting making articles are used in different types of sports. Such articles include, for example, baseball bats, racquets (such as tennis racquets and racquetball racquets), clubs (such as golfclubs) and sticks (such as hockey sticks and lacrosse sticks). These articles are used by having the participant grip the handle while swinging the article to make contact at the impact end of the article with some other object such as a ball or puck. It would be desirable from the standpoint of comfort and performance if the gripping area could include some form of sting minimizing cover.

The present invention may be useful with various types of hand held swinging athletic contact making articles. The usefulness of the invention might be best appreciated when considering a baseball bat as such a contact making article. The following discussion in this background section re-states what is known from the available literature.

In the world of physics, the larger the bat is, the better it is for hitting a ball, and it has even been recommended using a bat that weighs up to three pounds. Although the most recent rules of baseball do not specify a maximum or minimum weight, the average wooden bat used by professional baseball players weighs about 33 ounces (just over 2 pounds). The main reason why players choose to use lighter bats, than during the early days of baseball, is because the pitchers can throw the ball much faster now, and it would be virtually impossible for a batter using a 48 ounce bat to consistently hit a baseball pitched at over 80 mph.

Babe Ruth preferred to use a 40-ounce bat and did it very efficiently. Today most of the better hitters prefer 32 to 34 ounce bats, in the 34-inch length range. Batters have learned that a bat's speed has as much or more to do with the distance a ball is hit, as does the bat weight.

The Physics of a Baseball Bat

The average baseball bat used today is approximately 34 inches in length, and if you apply enough force to that bat, it will oscillate or move back and forth in a wave fashion. It is this force that is translated into energy, as oscillations, which make the bats sting or even break. An oscillation is a movement that is repeated regularly to establish a wave pattern.

Every object has a natural frequency or resonant frequency. The resonant frequency is the frequency of the wave, which is produced after the application of an external force, which will generate the maximum wave amplitude. The amplitude is the size of the wave. The energy transferred through a wave is proportional to the square of the amplitude. The amount of vibration you feel, when a baseball strikes a bat, depends on the amount of oscillations.

Since the bat is not a totally symmetric object, the place where the ball hits the bat determines the frequency and the amplitude of wave.

Two waves will be generated when a ball meets a bat, during a swing at the plate. The impact of a baseball with a baseball bat takes approximately 1.5 microseconds. The first or initial wave is formed when the ball strikes a bat and the second wave is formed when the ball leaves the bat. The places where the two waves meet are called the nodes. In physics, these nodes are called points of destructive interference. The places where the waves are the further apart are called constructive interference or antinodes. If the bat is struck at its antinode, the bat will sting or even break. The antinodes are the points where the maximum amplitude and vibration will be generated. If the bat is struck at the nodal areas the two waves cancel out, stopping the oscillations. The nodes are located around the bats "sweet spot" which is located approximately six to seven inches from the large end of the bat. The antinodes are located near the head and the midpoint of the bat. See FIG. 1.

Also, the more the bat oscillates, the more energy the bat absorbs, so striking the bat at its antinodes wastes energy. To get the maximum output of energy from a baseball bat, the ball must strike close to the nodal areas or sweet spots, where the oscillations are muted and energy is not wasted. So most of the energy is returned back into the ball, pushing the ball faster and further.

The sweet spot is located approximately six inches (or seventeen centimeters) from the end of the barrel. The sweet spot measures approximately four to six inches in length on a metal bat, and smaller, approximately three to four inches on a wooden bat.

When the ball strikes a bat, not all of the kinetic energy is restored back to the ball; a significant amount of energy is lost into the bat. When the bat strikes the ball, the bat will naturally recoil. The recoil energy is lost energy, as far as the ball is concerned. All other things being equal you want as heavy a bat as possible, to transfer as much energy as possible back to the ball, but a compromise must be reached for each player. See FIG. 1.

When the ball hits the bat at its center of mass, the bat will simply recoil. Collisions occurring elsewhere will cause the bat to rotate about its center of mass. So the energy that is wasted, in both the recoil and rotation, tends to reduce the energy that goes back into the ball lowering its exit speed.

The bat not only recoils and rotates but it also vibrates resulting in the bat stinging or even breaking. Whatever the impact is not on involved sweet spot, the collision creates vibrations that propagate back and forth along the bat, much like the vibrations on guitar string. And in general, any energy that goes into exciting vibrations in the bat, is energy that does not go into propelling the ball from the bat.

Hitting a ball on a sweet spot does not really add that much distance, but saves wear and tear on hands as does decreasing the amplitude by dampening.

While vibration-free zones on most wooden bats are similar, those on aluminum bats are different. The aluminum is harder to bend, making an aluminum bat about twice as stiff as its wooden counterpart. The aluminum bat is a hollow cylindrical shape and is more rigid than a solid wooden bat. The mass is more uniformly distributed along an aluminum bat and its moment of inertia is increased which induces less rotation. An important consequence is that the sweet spot is larger for aluminum bats, allowing more room for error.

While the bat does deform slightly under the impact, it takes time for the pulse of energy to travel down the length of the bat and back up again. By the time the pulse has returned to the site of impact, the ball is long gone. Approximately 1.5 microseconds after the initial contact of the ball, the bat will lose contact with the ball. The bat will not be able to transfer any additional energy to the ball past that point, so the batter is only wasting precious energy trying to "muscle the ball" any further.

Aluminum baseball bats are stiffer and weighted differently than the wooden bats, so the sweet spots are larger and can project balls farther. Aluminum bats were developed and initially used because they were money-saving devices. Wooden bats are expensive and break easily, while aluminum bats are virtually indestructible. Because the aluminum bats are hollow and their mass distribution is much more adjustable, you can produce a bat with a barrel diameter which is larger and closer to the handle. This produces a larger sweet spot, which extends further towards the handle. This is a great help in handling inside pitches. Aluminum bats can also be "tuned" so they deform and recover in sync with the ball. This allows them to transfer energy to the ball more efficiently and studies have shown that aluminum bats can project balls up to 10 percent further than wooden bats under similar conditions. Despite all of this, one of the aluminum bat's major disadvantages is that it will transmit vibrations very efficiently, causing a greater stinging sensation in the hands. Aluminum bats are illegal to use in any professional game.

The Fundamentals of Vibration and its Relation to Baseball

Mechanical vibration is a form of wave motion and is initiated by the energy created with the collision of the bat and ball. A wave can be described as a disturbance or vibration that travels through a medium, transporting energy from one location to another location. The medium is simply the material through which the disturbance is moving; it can be thought of as a series of interacting particles. The particles of the medium, through which the waves are moving, are vibrating in a back and forth motion at a given frequency. The frequency of a wave refers to how often the particles of the medium vibrate when a wave passes through the medium. The frequency of a wave is measured as a number of complete back and forth vibrations of a particle of the medium per unit of time. If a particle of medium undergoes 1000 longitudinal vibrations in two seconds, then the frequency of the wave would be 500 vibrations per second. A commonly used unit for frequency is Hertz (abbreviated Hz), where: 1 Hertz=1 vibration/second.

Wave interference is the phenomenon which occurs when two waves meet while traveling along the same medium. The interference of the waves causes the medium to take on a shape that results from the net effect of the two individual waves upon the particles of the medium. If two crests of a wave having the same shape meet while traveling in opposite directions along the medium, the medium will take on the shape of the crests with twice the amplitude of the two interfacing crests. This type of interference is known as constructive interference. If a crest and a trough of waves having the same shape meet while traveling in opposite directions along the medium, the two pulses will cancel each others effect upon the displacement of the medium and the medium will assume the equilibrium position. This type of interference is known as destructive interference.

Natural Frequency

Nearly all objects, when hit or struck or somehow disturbed, will vibrate. The frequency at which an object tends to vibrate is known as its natural frequency. If the amplitude (or height) of the vibrations is large enough and if natural frequency is within the human frequency range, then the object will produce sound waves, which are audible. All objects have a natural frequency or set of frequencies at which they vibrate.

An alteration, in either the speed or the length of the waves, will result in an alteration of the natural frequency. The state at which the wave moves throughout object depends upon the properties of the specific medium.

The wavelength will depend on the length of the medium. For instance, the vibrating portion of a guitar string can be shortened, by pressing the string against one of the fret on the neck of the guitar. This modification in the length of the string would affect the wavelength of the wave and in turn the natural frequency at which the particular string vibrates. As later described, the present invention acts in this way, by shortening the amount of bat material that will vibrate freely, thereby reducing the amplitude and changing the frequency.

As mentioned previously and illustrated in FIG. 1, when a ball strikes a baseball bat two vibration or waves or modes are excited. The first mode (530 Hz) occurs when the ball strikes a bat and the second mode (170 Hz) occurs when the ball leaves the bat. Because the impact of the baseball with the bat takes approximately 1.5 microseconds, the fundamental and secondary vibrational modes are both excited with about the same amplitude. Hence there are two vibrational nodes in the barrel. And impact at the fundamental node will not excite that mode, but it will excite the second mode.

Similarly, an impact at the node of the second mode will not excite the second mode but it will excite the fundamental mode. The ideal spot to hit the ball is halfway between the two nodes since both nodes will be excited but only with small amplitude. This spot is also close to the center of percussion.

When you push an object, with the force directed towards the exact center of mass, the object will accelerate but it will not start rotating about its center of mass. There is no torque being developed. The lever arm is 0. No torque implies no angular acceleration. When you push on it with a force not directed towards this center of mass, you exert a torque because the force now has a lever arm. This will result in a linear as well as anger acceleration of the object. The linear acceleration is a result of the force and the angular acceleration is a result of the torque.

If a ball hits the bat right at the center of mass, the bat will accelerate backward without rotating. The bat's handle will jerk backward in the batter's hand. If the ball hits further away from his hand, the bat will accelerate backward, but at the same time start rotating about its center mass. This rotation moves the handle forward, while the translation moves it backward. If the ball hits at just the right spot, called the center or percussion, the backward and forward accelerations exactly cancel and the batter can swing the bat smoothly without feeling much of a jerk. The center of percussion is one of the sweet spots.

Engineering & Innovations in the World of Wooden Baseball Bats

The game of Baseball is part of American culture and has been since the early $20^{th}$ century. The sport is changing with time. From yesterday's Babe Ruth to today's great hitters, a major part of the sport revolves around batting or the offensive part of the game. So engineers are constantly trying to reinvent the baseball bat.

There are basic physical properties in every baseball bat that will affect the way the ball is hit off the bat. These properties are: the bats weight, the distribution of the weight, the center of gravity (COG), the center of percussion (COP) also known as the "sweet spot", and the firmness and the strength of the material used.

One of Newton's laws of physics states that in any collision, momentum is always conserved. Momentum is equal to an object's mass multiplied by its velocity. In baseball, the hitter strives to hit the farthest possible ball by swinging a heavier bat. A more massive bat allows more momentum to be shifted from the bat to the ball. In theory, a baseball player wants to swing the heaviest bat the fastest he or she can in order to generate maximum momentum, to be transferred during the collision, with the bat. This results in faster and further travel of the ball. However, because baseball players are not superhuman, as the weight of the bat increases, the ability to generate bat speed decreases, which in turn lessons the momentum produced. With a heavier bat, the velocity slows down and the ball, is not able, to be hit as far.

Most of the bats weight is concentrated at the center of gravity. The center of gravity is the spot at which the bat can be balanced horizontally. Each bat has its own center of gravity. Its location is based on the weight distribution of the materials used. A balanced bat is more symmetric, which makes it easier to get the barrel around in a swing. A bat that is heavier near the barrel end is called barrel heavy and is harder to swing fast because the weight is mostly distributed away from the axis of rotation, or where the person's hands are on the bat. Although the barrel heavy bats are harder to swing, manufacturers are producing more end-loaded bats since they move the sweet spot, or the center of percussion, towards the barrel end of the bat. Engineers or manufacturers align the center of gravity in the bats of the same weight differently. In wooden bats, the addition or removal of knobs, the sanding of the handle, or the scooping out of the barrels end are several ways in which the center of gravity is altered. Depending on where the batter wants most of the weight of the bat, engineers are responsible for designing a bat that passes the requirements of the specific leagues.

Mechanics that Generate Bat Speed

Many tests have shown that rotational mechanics are far more efficient than linear mechanics in developing bat speed. In order to understand the mechanics of how rotational energy, developed by the body, is transferred to develop bat speed, it is important to have a good comprehension of the forces acting on the bat that can affect its rate of angular displacement (bat speed). Other than the effects of gravity, there are two main forces doing work on the bat that determines a bat speed. One is derived from the "energy of rotation" and the other is "torque".

The bat will undergo angular displacement (rotation) when the path of the hands is also undergoing angular displacement. In other words, as long as the path of the hands stay in a circular path, angular bat speed will be developed.

The concept that a substantial portion of good hitter's bat speed is derived from the circular path of his hands may be better understood if we think of swinging a ball on the end of a string. As long as we keep our hands in a circular path, the ball will continue to accelerate in a circle. But once the hand path straightens angular displacement slows. The same is also true for the bat head.

Torque is a result of two forces being applied to an object from opposite directions, which causes the object to rotate about a point. Forces in the same direction may cause the object to accelerate, but will not cause the object to rotate about a point (no angular displacement).

The combination of rotational energy and the length of time of those forces are being applied to the bat will determine the rate of angular displacement. It is important to remember that mechanics that accelerate the hands in a straight line and apply forces of both hands in the same direction can not develop a maximum bat speed.

The swinging mechanics of the great hitter allows them to generate higher bat speed much earlier in the swing than the average hitters. All of their bodies rotational and torque energies are expanded before and at contact. After contact their limbs go into a relaxed mode. The follow-through portion of the swinging is from the momentum. There is no such thing as follow-through, the ball is in contact with the bat for only about 1/2000 of a second.

Wrist Action and Torque

Consider what is requested to produce a powerful and quick baseball swinging where the bat head is accelerated to a speed in excess of 70 mph in less than 5/30 of a second. About half the speed is developed in the last time 1/30 of a second. The large mount of inertia that must be overcome to accelerate the bat heads 35 mph or more in 1/30 of a second requires far more energy than the muscles in the hands, wrist and arms can produce. That kind of energy must initially come from the large muscle groups in the legs, back and shoulders. The large muscle groups in your legs and back rotate your hips and shoulders to a point where the abdomen and chest are now facing the pitcher.

Now the bottom hand is being "pulled back" as the top hand is being "driven forward", generating a tremendous amount of torque on the bat. Torque is a result of forces being applied to the bat from opposing directions that causes an object (the bat) to rotate about a point between the two hands, so the hands are acting as a fulcrum. It appears that there is a "push-pull" action between the hands, generating a large amount of torque. This torque was initially developed in the large muscle groups, and then transmitted through the arms and wrists, into the bat, causing the bat head to be greatly accelerated. The bat will accelerate up to 70 mph so it is the major factor in developing bat speed.

If the batter does not initiate the swinging with torque and rotational forces, he will not be able to obtain the position of power required to apply maximum torque to the bat before contact.

The Medical Aspects of Vibration

The medical consequences of long-term and multiple short-term exposures of the body to vibrational energy have only recently come to light, and are, only now, being taken seriously as a danger to one's health. Another major concern is the issue of "overuse" trauma to the body. The deleterious effects that vibrations have on the entire body are now being closely studied by the medical profession. For our purposes, in studying the effects of athletes, we will be concerned with, the damage caused by vibrations and overuse injuries, involving the hands, wrist, elbows and shoulders.

As a physical phenomenon, vibrations can be defined as mechanical oscillation. The factors determining biological effects of vibration are becoming increasingly important to the clinician. Apart from the penetration, the relevant factors regarding the biological effects of vibration appear to be the frequency band, the condition of work and the individual's sensitivity. Frequency determines which tissues might be damaged. The deleterious effects of vibration usually occur at 2.8- to 2800 Hz. Individuals differ but the duration of the exposure and conditions of the exposure, such as holding the bat too tightly appears to be important to vibration injuries.

A general complaint of hand pain can have multiple diagnoses, but most are related to traumatic injuries of the joints, tendons or nerves within the wrist, hand and fingers. Through each hand and into each finger run tendons, nerve and blood vessels. The tendons attach muscles to bone and are protected by symposium. Some of the common related problems for the hands and wrist that have as their bases in, "over use" and vibrational injuries are arthritis, osteoarthritis, repetitive strain injuries, tenosynovities and carpal tunnel syndrome.

Vibrational and overuse injuries to the forearm and elbow are very common in sports involving bats, racquets and throwing. Any sport that entails repetitive flexion—extension of the elbow or pronation-supination of the wrist can lead to overuse injuries. Vibratory energy that is transmitted from instruments, such as baseball bats, tennis racquets and golf clubs, add to, or can be the sole cause of these lower arm problems. The three strain related conditions, which are often seen are: tennis elbow or lateral epicondylitis, golfers elbow or medial epicondylitis and bursitis of the elbow joint.

Another group of diagnoses, affecting the upper extremities, caused by vibrational damage are called the hand—arm vibration syndrome. As a physical phenomenon, vibrations can be defined as mechanical oscillation. The effect of vibration is becoming increasingly important to the physical. Vibrational Syndromes may cause Raynaud's syndrome, peripheral neuropathy and tunnel syndromes.

Apart from the penetration, the relevant factors regarding the biological effects of vibration appear to be the frequency band, the condition of work and the individual's sensitivity. Frequency determines which tissues might be damaged. The deleterious effects of vibration usually occur at 2.8- to 2800 Hz. Individuals differ but the duration of the exposure and conditions of the exposure, such as holding the bat too tightly appears to be important to vibration injuries.

Hand-arm vibration syndrome, traumatic vasospastic disease and Raynaud's phenomenon characteristically occur in fingers exposed to vibration, and are characterized by recurrent episodes of finger blanching due to partial or complete closure of the digital arteries. Exposure to cold may serve to trigger vasospasm in the fingers. Forceful gripping and prolonged exposure to vibration can cause this problem. The symptoms are progressive and may begin with intermittent numbness and tingling leading to whitening of the tips of the fingers, pain and skin that turns pail and cold as the fingers start to blanch.

The most common shoulder injuries are tendonitis/bursitis and irritation or tear of the rotator cuff. The rotator cuff is made up of four tendons that attach around the head of the upper arm bone or humorous in the joint made of the shoulder and arm bone. They function in the rotation of the arm and shoulder.

These tendons are poorly supplied with a blood flow and have few blood vessels. Constant use or trauma causes microscopic tears in the fibers of these tendons. Because of the poor blood supplying, these tears heal very slowly.

This area is very small and can become very crowded when the tendons are inflamed from too much work or when calcium deposits accumulate on the nearby bony areas. If the tendons simply become inflamed, it is called tendinitis. There is a lubricating sack around the joint. It contains synovial fluids. If this sac, which must fit into the area also, becomes inflamed or irritated, we call it bursitis.

This injury has several levels of seriousness; Level 1 is a simply inflammation. This level is more common in younger players or in beginners. Repetitive movements cause irritation, which causes an inflammation of one or more of the tendons. Since the blood supply is poor, the healing process is much slower than normal. Then out of enthusiasm, the activity is again performed and more damage (irritation) occurs. More damage is done before the tendon can heal naturally. Level 2 is inflammation with scarring. This is more serious because the tendon becomes inflamed and thickens in the small space. The tendon begins to rub more consistently and pain sets in.

Level 3 is an actual tear. This is more common in older players but younger players can also get a true tear. Besides pain there is a decrease in the ability to move the shoulder and a marked weakness. These injuries usually occur with repetitive movements of the arm or vibrational injuries.

The psychological aspects of pain and the anticipation of pain can have a devastating effect on the athlete's performance. If an athlete has experienced the discomfort of pain in the past, such as an injury from playing or over use pain; or even the simply stinging pain received when a baseball strikes a bat or the pain of catching a line drive ball int eh palm portion of his glove; the memory of this incident may cause the athlete to hesitate, flinch or even try to avoid the situation. This can have devastating effect on the ability of this player to perform effectively.

Distraction is damaging to your performance because it interferes with your ability to focus and disturbs flow. It interferes with the attention that you need to maintain good technique. This causes stresses and consumes mental energy that is better applied elsewhere.

High anxiety is typically the major cause of choking and it leads directly to a decrease in performance. Each athlete's potential for choking depends on the athlete and the situation. If anxiety increases beyond the optimal level necessary for the given task, a declining in performance will follow. In addition, self—doubts regarding one's performance and a desire to impress others will create a high level of anxiety. Once choking occurs, the athlete's focus on the game is lost as is the physical control of the performance. Usually athletes will choke in situations when they try to impress others and/or have self doubts related to their performance.

Choking starts out as a cognitive problem and ends up the physical one, and thus negatively affects performance. Choking begins with negative self-talk and fear. It is the interpretation of a task as threatening, painful or a situation as extremely important. This causes feelings of tension and anxiety, both of which distract you from the task at hand and therefore impede performance. After the stress come the physical consequences. The athlete is so worried, unfocused and physically tense that there is no way he can let his natural instincts takeover and be fluid in his movements. He tends to grip things tighter and fatigue prematurely because he is breathing in short, rapid and shallow. The tension causes constriction muscles in the chest and throat and there is reduced circulation of blood to his limbs. This is due to the fight or flight response. Unfortunately, in sports this is a negative.

SUMMARY OF THE INVENTION

An object of this invention is to provide a grip for a hand held swinging athletic contact making article such as a bat, racquet, club or stick.

A further object of this invention is to provide such a grip which would minimize sting when swinging the article and making impact with an object such as a ball or puck.

In accordance with this invention an athletic contact making article has an impact end and a handle connected to the impact end. A gripping cover is mounted on and around the handle for minimizing sting when the handle is held and the impact end makes a striking contact with an object such as a ball or puck. The gripping cover or grip is a multi-layer laminate which includes an inner layer mounted around the handle and an outer exposed layer. The inner layer is made from an elastomeric material having high energy absorption and vibration damping characteristics. The exposed outer layer is made of a material having a high coefficient of friction and is pliable. The laminate also includes force dissipating material which has the characteristics of absorbing and redirecting vibrational energy. The force dissipating material may be a separate layer between the inner and outer layers or may be incorporated in one or both of the inner and outer layers in addition to or instead of being a separate layer.

THE DRAWINGS

DETAILED DESCRIPTION

The present invention is in general directed to a vibration damping grip for covering the handle of an article of athletic equipment and in particular a swinging article such as a bat, racquet, club or stick which would make contact with an object such as a ball or puck. In general, the grip may be made of the material and use the techniques described in co-pending application Ser. No. 09/917,035 filed Aug. 27, 2001, all of the details of which are incorporated herein by reference thereto. The aforesaid patent application also refers to vibration absorbing material as disclosed in U.S. Pat. Nos. 5,653,643 and 5,944,617, all of the details of which are incorporated herein by reference thereto.

In general, the grip of this invention is a combination of materials in the form of a composite having distinct layers. These layers include an inner layer which would be disposed against the handle of the article, such as a bat, and an exposed outer layer which would be gripped by the player when using the article. A third material is a force dissipating material which may be incorporated as a separate intermediate layer or which may be incorporated into one or both of the inner layer and outer layer.

Figure 3:
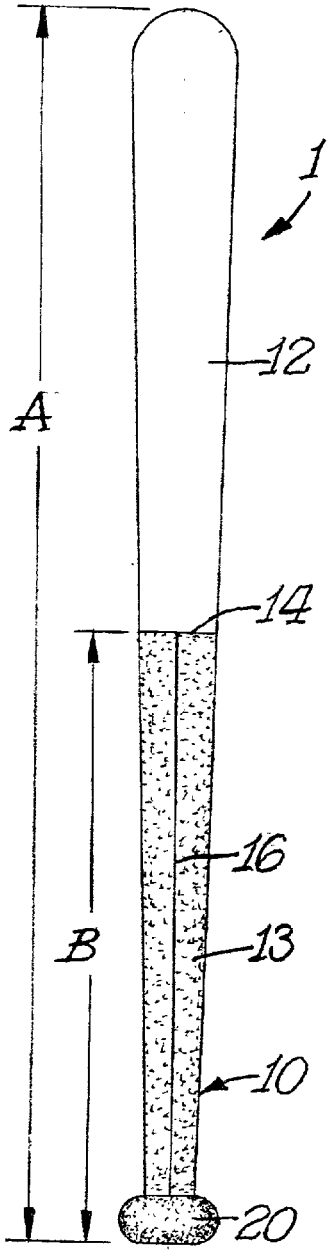
FIG. 3 is a side elevational view of a baseball bat in accordance with this invention.

FIG. 3 illustrates a baseball bat 1 having an impact end 12 and a handle 13 connected to the impact end. In accordance with this invention a gripping cover or grip 10 is mounted over the handle 13. The bat 1 may be of any suitable conventional length indicated by the letter A which could be, for example, from 34 to 42 inches long. The grip 10 would cover a sufficient area of the handle 13 so as to permit the user to hold the bat in a conventional manner at a conventional location. Since major league baseball rules prohibit a bat handle from being covered more than 18 inches from its end, grip 10 does not extend beyond the portion 14 of handle 13 which would correspond to the distance B and would be 18 inches. A length of 17 inches might be used to avoid any possibility of the grip unintentionally extending too long.

Figure 4:
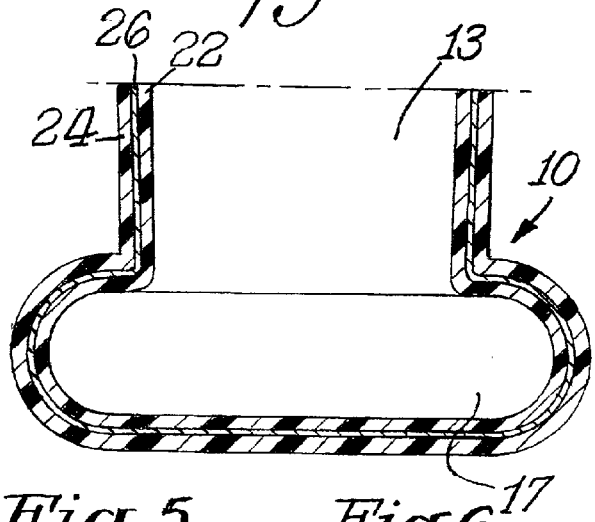
FIG. 4 is a cross sectional view in elevation of the knob end of the baseball bat shown in FIG. 1.
Figure 5:
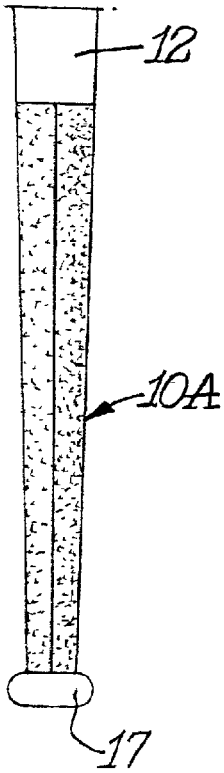
FIGS. 5 and 6 are views similar to FIG. 3 of modified forms of grip construction in accordance with this invention.
Figure 6:
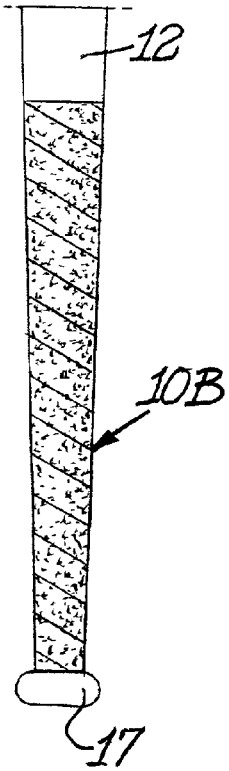

Grip 10 may be mounted on handle 13 in any suitable manner. For example, grip 10 could be in the form of a sleeve having a slit 16 to permit the premolded sleeve to be snapped over the handle 13 including over the knob 17 as shown in FIGS. 3–4 so that the grip sleeve thereby includes an outward protrusion 20. Alternatively, as shown in FIG. 5 the grip 10A might leave the knob 17 exposed. FIG. 6 illustrates yet another modification of the invention wherein the grip 10B is mounted by being in the form of a tape wrapped around the handle with the knob 17 exposed or with the knob covered.

In the preferred practice of the invention the knob is covered. This may be done by making the grip 10 of one piece construction as shown in FIG. 3. Alternatively, the grip could be of two pieces where one piece is tubular to cover the portion of the handle outwardly from the knob and the second piece covers the knob itself. The two pieces are then secured together in any suitable manner such as by gluing or by adhesive. If desired, the knob piece may include an extension slightly outwardly of the knob and the two pieces could overlap outwardly of the knob. Where tape is used for grip 10, the end of the tape could extend from a pre-formed knob.

The grip of this invention, by adding several ounces of weight to the handle portion of the bat and knob, will move the center of gravity closer to the axis of rotation or where the persons hands are holding the bat. The grip adds weight to the knob area and also to the area below where the hands grasp the bat. This adds weight, to the area below the rotational axis (or fulcrum) of the bat; reweighting the lever mechanism, causing the barrel or impact end of the bat to become lighter. This redistribution of the weight actually makes it easier to get the barrel end of the bat around in a swing, so even though the overall mass has increased, the ability to swing the bat faster has now also actually increased.

A baseball can be hit the farthest with a bat of greater mass. In the real world, with present day technology, the lighter bats are being chosen because the lighter the mass and the lighter the barrel end of the bat, then the easier it is to swing. However, with the grip technology of this invention, a bat of heavier mass can be chosen with better ease of swinging. This could help to equalize the differences of the skill levels and strength between the different batters.

Figure 2:
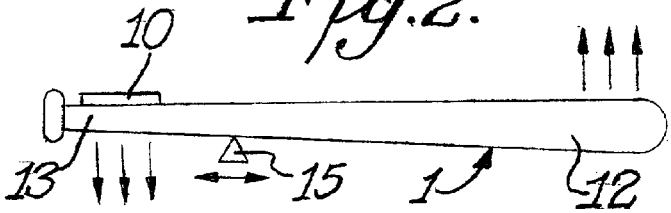
FIG. 2 is a diagram illustrating the principles of this invention in connection with a baseball bat.

FIG. 2, for example, shows the affect of including the grip 10 on a bat 1. The added weight from grip 10 below the rotational axis or fulcrum 15 causes the impact end or barrel to feel lighter when impact is made in the direction of the arrows at impact end 12 and the player is swinging the bat in the direction of the arrows at handle 13.

The grip 10 becomes very important in the production of the torque of the bat. The grip 10 has a high coefficient of friction and is soft and pliable. These qualities allow the batter to grip the bat with less effort. The grip 10 is easier to hold onto. The hands will mold into the grip, so it is not necessary to squeeze hard to attain a good, secure, comfortable hold on the bat. This looseness in the batters hands and wrists will also allow the "push-pull" action to occur easily and fluently. There will be better action in the wrists and a better unlocking and snap in the wrists, so that the torque will be developed more efficiently.

Conventionally when a grip is covered with tape or other material, the material extends from 8 to 12 inches up the bat. With the preferred practice of the invention the grip cover 10 extends over 12 inches from the knob and preferably covers the knob. More preferably the length of the grip 10 is at least 15 inches and most preferably at least 17 inches. The longer the length of the grip 10, the more the grip adds to the weight of the handle and to the reduction of the amplitude of vibration.

FIG. 4 illustrates the multi-layer nature of the composite which forms the grip 10. As shown therein, an inner layer 22 is mounted against the bat handle 13. An outer layer 24 is exposed and would be in contact with the batter's hands. An intermediate layer 26 is located between layers 22 and 24.

The laminate forming grip 10 is a unique combination or composite consisting of three distinct layers.

The first layer 22 is the innermost layer, consists of an elastomer of a low durometer reading, approximately 10 to 42 and preferable 26 Shore Class A and also having a high energy absorption or damping capabilities.

The second layer 26 is the middle layer and consists of Kevlar 29 (aramid) fiber style 645. This layer has the ability to absorb energy and also to redirect the energy.

The third layer 24 is the outermost layer consisting of elastomer of lower durometer (between 25 and 42 Shore Class A). It exhibits high energy absorption or damping. This layer is also very pliable and has a high coefficient of friction, which gives it spectacular gripping ability. If desired, less preferred materials such as rubber may be used.

The main component of the first and third layers 22, 24 is an elastomer. This is just a fancy word that means "rubbery". Elastomers are divided into two main categories, the thermoplastic elastomers and the thermoset elastomers. The thermoplastic elastomers have a polymer chain that are not crossed thus allowing them to be molded and remolded again and again. So a thermoplastic is an elastomer that can be molded when it is heated. This is possible because in the thermoplastic elastomers, bonds, which are weaker than the cross-linked rubber type allowing them to break apart when the right amount of heat is applied, hold the polymer chains together. Thermoset elastomers, have cross-linked bonds and because of this are not remoldable. The grip 10 can be formed from either thermoplastic or thermoset materials.

The materials for layers 22 and 24 are preferably thermoset elastomers including silicone or polyurethane. The latest material used has been polyurethane with Shore A durometer readings ranging from 10 to 42. Polyurethanes are extremely versatile. Qualities include:

1. Resistant to abrasion—they will outwear a material such as rubber.
2. It has a high load—bearing capacity.
3. It is impact resistant—they resist breakage even the hardest formulations.
4. They have great elasticity. Under repeated flexing, polyurethanes resist cracking as well as most other elastomers.
5. The material holds its shape well.
6. It has high shock absorbing capability.
7. It has an excellent capability to absorb vibration (damping)
8. It is resistant to thermal shock remaining flexible at very low temperatures and are stable to up to 250 degrees F.
9. It remains stable in water, it absorbs almost no water.
10. It has excellent electrical insulating properties.
11. It is virtually immune from attack by ozone and oxygen.
12. It resists attack from a wide range of chemicals and substances such as solvent soil and grease.
13. It has a high coefficient of friction and pliability.
14. Polyurethanes can be bonded to a wide range of materials.

The force dissipating material is preferably Kevlar, a DuPont registered trademark for a unique family of aramid fibers. It is woven into a multi-directional fabric. Kevlar fabrics have five times the strength of steel and are over ten times as strong as aluminum. The fabrics will not melt or support combustion but will start to carbonize at about 800 degrees F. Aramid material shows no embrittlement or strength loss even at temperatures as low as −320 degrees F. The aramid materials have the ability to absorb and redirect vibrational energy along its fibers. Other force dissipating material such as fiberglass may also be used.

The physics behind the effectiveness of the grip 10 is extremely complicated. To start with, it is a composite. Composite materials are a unique class of materials made by combining two or more materials to obtain a new material that contains the properties, from all the components. This new material offers significant advantages over just a single layer material. The composite materials used in the grip 10 are composed of two different layers of a matrix material reinforced with aramid fibers. The two different matrix layers (the inner and outer layers) are composed of thermoset materials, preferably polyurethane elastomers and may have the same or different durometer readings and coefficient of friction. The difference in the two matrix layers will be determined by its specific use in the product. The reinforcing fibers are the primary load carriers of the material, with the matrix component transferring the load from fiber to fiber. Reinforcement of the matrix material may be achieved in a variety of ways. The fibers may be either continuous or discontinuous and possibly the reinforcement may also be in the form of particles. The matrix material can be one of many available engineered polymers.

Selection of the optimal reinforcement fiber and material of the matrix is dependent on the property requirements of the finished product.

In grip 10 the inner matrix layer 22 is an elastomer (polyurethane) with a durometer reading between 10 and 42 Shore Class A. This layer is used e.g. to absorb mechanical vibration turning it into heat. This mechanism is known as histeretic damping.

The second or middle layer 26 is preferably composed of Kevlar material. The Kevlar itself will absorb vibration. It will then change the direction of the vibratory energy, along its fibers.

The third or outer matrix layer 24 is also composed of an elastomer (e.g. polyurethane) of which a durometer reading will be between 25 and 42 Shore Class A. This layer 24 is also involved with the absorption of vibration utilizing the histeretic damping mechanism. This layer is the outside layer or the layer that will be in contact with the hands. This external layer has been designed with a high coefficient of friction. The material in this layer is also very pliable. This combination of the batters fingers being able to mold into the material and the high coefficient of friction of the material gives this layer 24 an extremely high friction, allowing easy comfortable gripping properties. If the batter is also wearing a pair of batting gloves, the frictional properties of the gloves are added to that of the grip 10 and the holding ability or coefficient of friction is increased geometrically.

Although the inner layer preferably has a durometer reading less than that of the outer layer, the invention could be practiced where either layer is harder or softer than the other layer or where both layers are of the same hardness.

Figure 1:
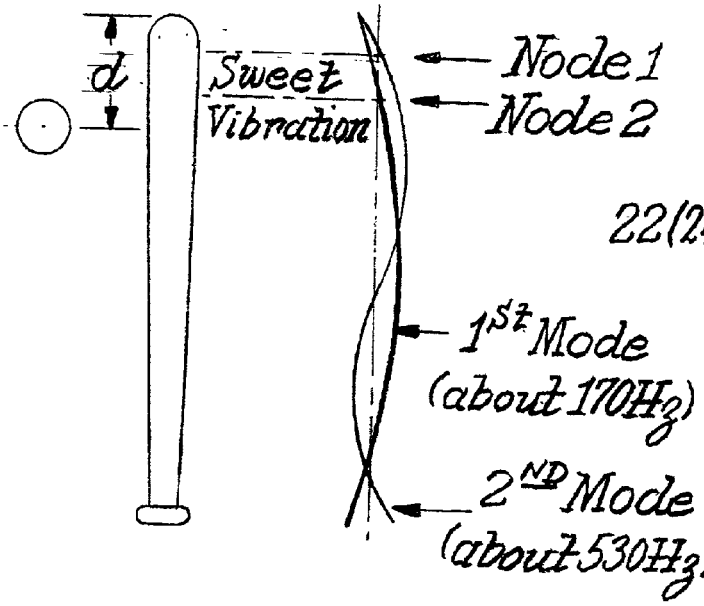
FIG. 1 is a diagram showing the affect of a bat striking a ball.
Figure 9:
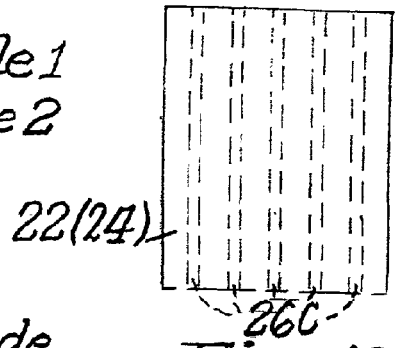
FIGS. 9–12 are plan views showing various arrangement of force dissipating fibers incorporated in one of the layers of the grip in accordance with this invention.
Figure 10:
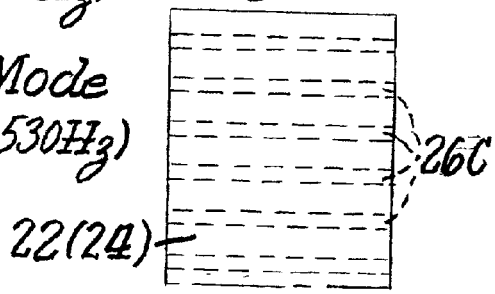
Figure 7:
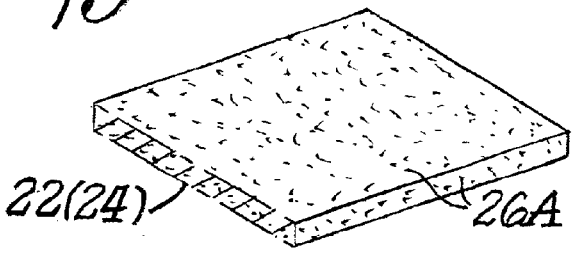
FIG. 7 is a perspective view showing one of the layers of a grip incorporating force dissipating material in the form of particles.
Figure 11:
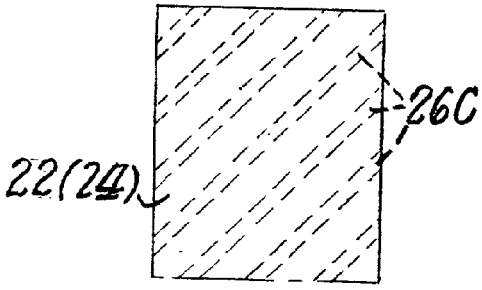
Figure 8:
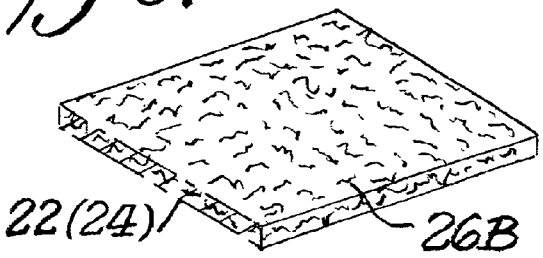
FIG. 8 is a view similar to FIG. 7 showing the force dissipating material in the form of fibers.
Figure 12:
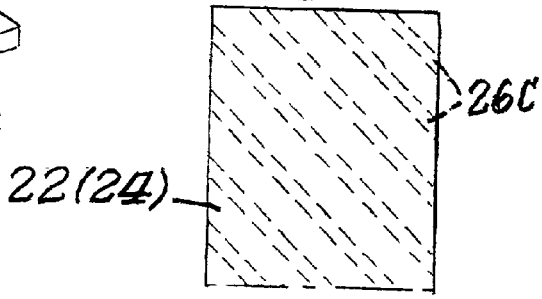

The force dissipating material may be included in the grip in various manners. FIG. 7, for example, illustrates one or both layers 22 and/or 24 to include the force dissipating material in the form of particles 26A within the matrix of the layer. FIG. 8 shows the incorporation of the force dissipating material 26B to be in the form of fibers within the matrix of layer 22 and/or 24. FIG. 9 shows the force dissipating material 26C to be in the form of longitudinal fibers or strands within the matrix of layer 22 and/or layer 24. Similarly, layers 10–12 show the force dissipating material 26C to be in the form of fibers or strands arranged transversely or at various diagonal directions within the matrix of layers 22 and/or 24.

Figure 13:
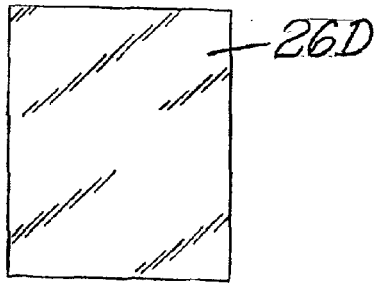
FIGS. 13–16 are plan views of force dissipating material incorporated as a separate layer in a grip in accordance with this invention.
Figure 14:
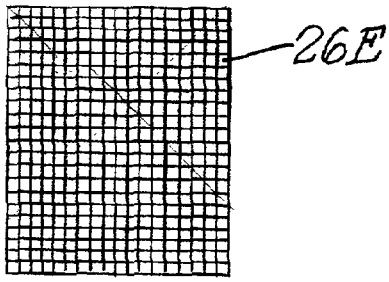
Figure 15:
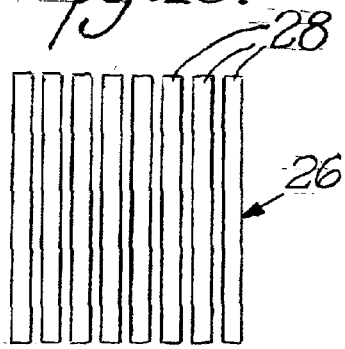
Figure 16:
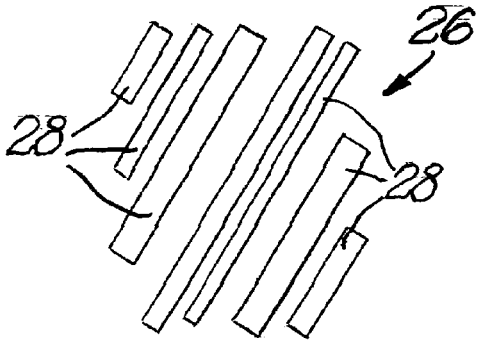

FIGS. 13–16 illustrate some of the forms the force dissipating material may take when incorporated in the laminate as a separate layer instead of or in addition to incorporating the force dissipating material within one or both of the inner and outer layers. Reference is made to application Ser. No. 09/917,035 for a description of such alternatives. Reference is also made to FIGS. 13–16. As shown in FIG. 13 the force dissipating layer 26D is in the form of a sheet or film. FIG. 14 illustrates the force dissipating layer 26E to be in the form of an open mesh. FIG. 15 illustrates the force dissipating layer 26 to be in the form of parallel uniform strands or fibers 28. FIG. 16 illustrates the force dissipating layer to have the strands 28 of differing length and to be at angles which may be randomly or uniformly distributed. The force dissipating material could be incorporated as a separate layer or within one or more of the other layers by being chopped fibers of any size or shape including being of variable size and shape within a layer. Other combinations are also possible as would be apparent of one of ordinary skill in the art.

The grip 10 has the following characteristics and advantages:

A. The composite grip material is excellent in damping vibrational energy. The elastomers will absorb vibrational energy and convert a portion of it into heat. The Kevlar will also absorb vibrational energy. Besides absorbing energy, the Kevlar material will dissipate and change the direction of the vibrational energy along its fibers. But the composite material, as a whole, has many extremely unique features. Previously mentioned, the materials will absorb, dissipate, change the direction and reabsorb energy. But, what is even more interesting is that with fiber reinforced composites, besides the viscoelastic nature of the polymeric matrix and the unique characteristics of the Kevlar, the friction at the interface of the different materials caused by the relative motion between the fibers in the matrix is another primary source of energy dissipation.

B. The composite grip 10 covers the handle and of the bat, including the knob for approximately 17 inches (any grip covered over 18 inches from the bottom of the bat is illegal). Because the grip 10 securely wraps around the bat for 17 inches, it reduces the amplitude and changes the frequency, by shortening the amount of bat that will vibrate freely, thereby also significantly damping the bat.

C. It is well known that by modifying the bats weight distribution, this changes the center of gravity, and a significant damping effect can be obtained. Therefore the grip 10, by adding several ounces of weight to the handle portion of the bat and knob, will move the center of gravity closer to the axis of rotation or where the persons hands are holding the bat. This changes the vibrational amplitude and has been shown to reduce it by 40%.

D. The grip 10 adds weight to the knob area and also to the area below where the hands grasp the bat. This adds weight to the area below the rotational axis (or fulcrum) of the bat, thereby reweighting the lever mechanism, causing the barrel end of the bat to become lighter. This redistribution of the weight actually makes it easier to get the barrel end of the bat around in a swing, so even though the overall mass has increased, the ability to swing the bat faster has now also actually increased.

E. The grip adding weight also has another advantage. A baseball can be hit the farthest with a bat of great mass. In the real world, with present day technology, the lighter bats are being chosen because the lighter the mass and the lighter the barrel end of the bat then the easier it is to swing. However, with the technology of grip 10, a bat of heavier mass can be chosen with better ease of swinging. This could help to equalize the differences of the skill levels and strength between the different athletes.

F. The grip becomes very important in the production of this torque. The grip has a high coefficient of friction and is soft and pliable. These qualities allow the batter to grip the bat with less effort. The grip is easier to hold onto. The hands will mold into the grip. The friction and the pliability work together so it is not necessary to squeeze hard to attain a good, secure, comfortable hold on the bat. This lack of tension in the batters hands and wrists will also allow the "push-pull" action in the hands to occur easily and fluently. There will be better action in the wrists and a better unlocking and snap in the wrists, so that the torque will be developed more efficiently. Thereby generating a faster more controllable swing.

G. The sting free or minimizing grip has advantageous affect on psychological aspects. The psychological aspects of the anticipation of pain can have a devastating effect on the athlete. If the athlete has experienced the discomfort of pain, such as the sting pain received when a baseball strikes a bat either proximal or distal to the sweet spot or if while catching a baseball in his glove the ball's energy is transmitted through the glove and the player receives a bruise. The memory of this incident may cause the athlete to hesitate, flinch or even try to avoid the situation. This can have devastating effects on the ability of this player to perform effectively. So, the prevention of the physical discomforts by the grip will give the players a great psychological advantage.

Figure 17:
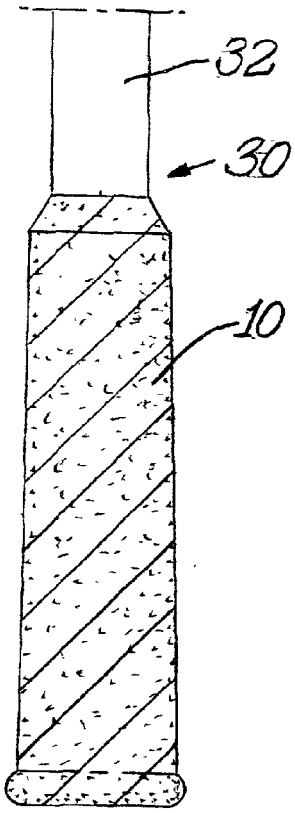
FIG. 17 is a plan view of a portion of a hand held swinging athletic contact making article other than a baseball bat having a grip in accordance with this invention.

While the invention has been described with particular reference to a baseball bat, other forms of articles may be used. FIG. 17, for example, shows a hand held swinging athletic contact making article 30 having a grip 10 as previously described mounted to the handle of the article 30 inwardly of the impact end 32. The article 30 may be a racquet such as a tennis racquet or racquetball racquet or badminton racquet, a club such as a golfclub, or a stick such as a hockey stick or lacrosse stick or any other athletic article having an impact end which strikes an object such as a ball or puck or bird.

While the invention has been particularly described with respect to two or three layer laminates it is to be understood that the invention could be practiced where the grip includes additional layers such as multiple layers similar to the inner layer and/or outer layer and/or force dissipating layer. Where such multiple additional layers are included the force dissipating material such as the aramid could be incorporated in one or more of the various layers.

The invention may also be broadly practiced with variations which would have different degrees of effectiveness. For example, instead of the multilayer composite, a grip could be formed which would cover the handle end of a baseball bat completely covering the knob and extending over 12 inches and preferably at least 15 inches and more preferably at least 17 inches from the handle end of the bat. The grip should be made of a material having some vibration damping characteristics and preferably having a tacky exposed surface. By providing such a grip the bat would be reweighted. The grip could be molded from a single layer foam material. If desired the material, whether foam or a material of the types previously described, could include strands, chopped fibers or particles made from any suitable material, such as polyurethanes or polyesters, including aramid fibers. The single layer of material could be comprised of 80% of such fibers or particles. The invention may also be practiced where such form of grip is used on other types of athletic articles previously described.

What is claimed is:

1. A vibration absorbing grip cover for a handle of an implement, comprising:

a sleeve having an upper end and a lower end, the upper end being open to permit a portion of the handle of the implement to extend therethrough, wherein the sleeve is a multi-layer laminate comprising:

an inner layer of elastomeric vibration absorbing material which is free of voids therein;

a layer including a fiberglass material and that is disposed on the inner layer, wherein the fiberglass material distributes vibration to facilitate vibration dampening;

an outermost elastomeric layer having a pliable outer surface that facilitates a user gripping the sleeve during use of the implement;

an outwardly extending peripheral knob portion forms the lower end of the sleeve; and a further inner layer made from force dissipating stiffening material.

2. The grip cover of claim 1, wherein the fiberglass material is a layer in open mesh form.

3. The grip cover of claim 1, wherein the outer gripping layer is made of vibration absorbing material.

4. A vibration absorbing grip cover for a handle of an implement, comprising:

a sleeve having an upper end and a lower end, the upper end being open to permit a portion of the handle of the implement to extend therethrough, wherein the sleeve is a multi-layer laminate comprising;

an inner layer of elastomeric vibration absorbing material which is free of voids therein;

a layer including fiberglass material and that is disposed on the inner layer, wherein the fiberglass material distributes vibration to facilitate vibration dampening;

an outermost elastomeric layer having a pliable outer surface that facilitates a user gripping the sleeve during use of the implement, and an outwardly extending peripheral knob portion forms the lower end of the sleeve, wherein the fiberglass material forms an imperforate sheet that is disposed within the elastomeric layer.

5. A vibration absorbing grip cover for a handle of an implement, comprising:

a sleeve having an upper end and a lower end, the upper end being open to permit a portion of the handle of the implement to extend therethrough, wherein the sleeve is a multi-layer laminate comprising:

an inner layer of elastomeric vibration absorbing material which is free of voids therein;

a layer including a fiberglass material and that is disposed on the inner layer, wherein the fiberglass material distributes vibration to facilitate vibration dampening;

an outermost elastomeric layer having a pliable outer surface that facilitates a user gripping the sleeve during use of the implement, and an outwardly extending peripheral knob portion forms the lower end of the sleeve, wherein the fiberglass material forms a plurality of individual strips that are substantially parallel to each other.

6. The grip cover of claim 5, wherein the plurality of individual strips are generally equally sized.

7. A vibration absorbing grip cover for a handle of an implement, comprising:

a sleeve having an upper end and a lower end, the upper end being open to permit a portion of the handle of the implement to extend therethrough, wherein the sleeve is a multi-layer laminate comprising:

an inner layer of elastomeric vibration absorbing material which is free of voids therein;

a layer including a fiberglass material and that is disposed on the inner layer, wherein the fiberglass material distributes vibration to facilitate vibration dampening;

an outermost elastomeric layer having a pliable outer surface that facilitates a user gripping the sleeve during use of the implement, and an outwardly extending peripheral knob portion forms the lower end of the sleeve, wherein the fiberglass material forms a plurality of individual strips of different sizes that are substantially parallel to each other.

8. A vibration absorbing material, comprising:

an inner layer formed by an elastomer that is substantially free of voids therein;

a layer including a fiberglass material therein and that is disposed on the inner layer, the fiberglass material comprising a plurality of individual strips of fiberglass of different sizes, wherein the fiberglass material distributes vibration to facilitate vibration dampening, the elastomeric layer being substantially free of voids therein;

an outermost layer that is disposed on the layer including the fiberglass material, the outermost layer being formed by an elastomer that is substantially free of voids.

9. The material of claim 8, wherein the outermost layer and the layer including the fiberglass material are generally of equal thickness.

10. A vibration absorbing material comprising:

an inner layer formed by an elastomer;

a layer including a fiberglass material therein and that is disposed on the inner layer, the fiberglass material comprising a plurality of individual strips of fiberglass of generally equal sizes, wherein the fiberglass material distributes vibration to facilitate vibration dampening, the plurality of individual fiberglass strips being generally parallel to each other;

an outermost layer that is disposed on the layer including the fiberglass material and is substantially free of voids therein.

11. The material of claim 10, wherein the outermost layer and the elastomeric layer are generally of equal thickness.

12. A vibration absorbing material, comprising:

an inner layer formed by an elastomer;

a layer which includes a high tensile strength fibrous material therein and that is disposed on the inner layer, wherein the high tensile strength fibrous material distributes vibration to facilitate vibration dampening;

an outermost layer that is disposed on the layer including the high tensile strength fibrous material, the outermost layer being formed by an elastomer, wherein at least one of the inner and outermost layers is substantially free of voids, wherein the high tensile strength fibrous material forms an imperforate sheet that is disposed within the layer.

13. A vibration absorbing material, comprising:

an inner layer formed by an elastomer;

a layer which includes a high tensile strength fibrous material therein and that is disposed on the inner layer, wherein the high tensile strength fibrous material distributes vibration to facilitate vibration dampening;

an outermost layer that is disposed on the layer including the high tensile strength fibrous material, the outermost layer being formed by an elastomer, wherein at least one of the inner and outermost layers is substantially free of voids, wherein the high tensile strength fibrous material forms a plurality of individual strips that are substantially parallel to each other, the plurality of individual strips are disposed within the layer.

14. The grip cover of claim 13, wherein the plurality of individual strips are generally equally sized.

15. A vibration absorbing material, comprising:

an inner layer formed by an elastomer;

a layer which includes a high tensile strength fibrous material therein and that is disposed on the inner layer, wherein the high tensile strength fibrous material distribute vibration to facilitate vibration dampening;

an outermost layer that is disposed on the layer including the high tensile strength fibrous material, the outermost layer bein, formed by an elastomer, wherein at least one of the inner and outermost layers is substantially free of voids, wherein the high tensile strength fibrous material forms a plurality of individual strips of different sizes that are substantially parallel to each other, the plurality of individual strips are disposed within the layer.

* * * * *